United States Patent [19]

Volland

[11] 4,078,662

[45] Mar. 14, 1978

[54] USED CHEWING GUM STORAGE RECEPTACLE

[76] Inventor: Alice F. Volland, 503 Westmoreland, Vernon Hills, Ill. 60061

[21] Appl. No.: 726,470

[22] Filed: Sep. 27, 1976

[51] Int. Cl.[2] ..... B65D 1/24; B65D 25/16

[52] U.S. Cl. ..... 206/564; 206/45.14; 206/45.34; 206/37; 206/496; 206/800; 220/405; 206/459

[58] Field of Search ..... 206/37, 496, 45.19, 206/45.34, 800, 564, 567, 459, 45.14; 220/65, 21, 23.8

[56] References Cited

U.S. PATENT DOCUMENTS

| | | | |
|---|---|---|---|
| 667,561 | 2/1901 | Norris, Sr. | 206/800 |
| 920,462 | 5/1909 | Hinkle | 206/459 |
| 2,007,261 | 7/1935 | Stover | 206/45.34 |
| 2,115,930 | 5/1938 | Lynn | 220/21 |
| 3,201,421 | 9/1965 | Hunger et al. | 206/459 |
| 3,485,344 | 12/1969 | Aylott | 206/564 |
| 3,533,503 | 10/1970 | Wood | 206/45.34 |
| 3,627,122 | 12/1971 | Garbe, Jr. | 206/459 |
| 3,885,668 | 5/1975 | McClain | 206/459 |
| 3,935,944 | 2/1976 | Wilson et al. | 206/45.34 |

*Primary Examiner*—George E. Lowrance
*Assistant Examiner*—Joseph M. Moy
*Attorney, Agent, or Firm*—Fitch, Even, Tabin & Luedeka

[57] ABSTRACT

A used chewing gum receptacle includes a base member in which a plurality of spaced recessed storage compartments are formed and a cover which is removably secured thereon. A disposable liner is provided with cup-like areas therein arranged in location and size to correspond with the storage compartments in the base. The liner is thus juxtaposable over the top surface of the base so as to nest the cup-like areas within the storage compartments of the base. In a preferred embodiment the rear edge of the liner is raised to provide a cover-retaining edge.

1 Claim, 4 Drawing Figures

USED CHEWING GUM STORAGE RECEPTACLE

BACKGROUND OF THE INVENTION

The present invention relates to receptacles for the storage of used chewing gum.

Receptacles for chewing gum were known heretofore. One such receptacle is disclosed in U.S. Pat. No. 603,949 issued May 10, 1898 to C. W. Harding. This early receptacle essentially consisted of a case having a base, wall sections of which one is pivotable to expose the interior the receptacle, and a spur or prong extending upwardly from the base upon which the wad of gum is secured. More recently U.S. Pat. No. 2,484,892 issued to R.H. Keaton discloses a chewing gum receptacle formed from a single piece of cardboard or like bendable material. The Keaton receptacle also utilizes a barb or prong to receive or impale the wad of gum.

The principal difficulty with prior chewing gum receptacles is in connection with the removal of the gum therefrom periodically. As is well known chewing gum adheres to most surfaces with which it comes into contact and hardens so as to be extremely difficult to separate from such surfaces. This is also true of the barbs and prongs employed in devices such as the patented receptacles of Harding and Keaton. Therefore, although the prior devices have possessed utility in affording a repository for used chewing gum which would otherwise, in many instances, be discarded on floors or fastened to concealed portions of furniture such prior devices nevertheless presented problems of removal which tended to limit their acceptance by the public.

SUMMARY OF THE INVENTION

It is the primary object of the invention to provide a receptacle for used chewing gum which is simple in construction, attractive in appearance, and affords easy removal of used chewing gum deposited therein.

Other objects and advantages of the invention will become readily apparent from the following description of the invention.

According to the present invention there is provided a receptacle for used chewing gum comprising in combination: a base member having a plurality of spaced recessed storage compartment therein; a cover removably secured to the base member; and a disposable liner having depressed cup-like areas therein arranged in location and size such that the liner can be juxtaposed over the base member and the depressed cup-like areas thereof will nest within the corresponding storage compartments in the base member.

BRIEF DESCRIPTION OF THE DRAWINGS

In order that the invention may be more fully comprehended it will now be described, by way of example, with reference to the accompanying drawings in which.

DETAILED DESCRIPTION OF THE PREFERRED EMBODIMENT

Figure 4:
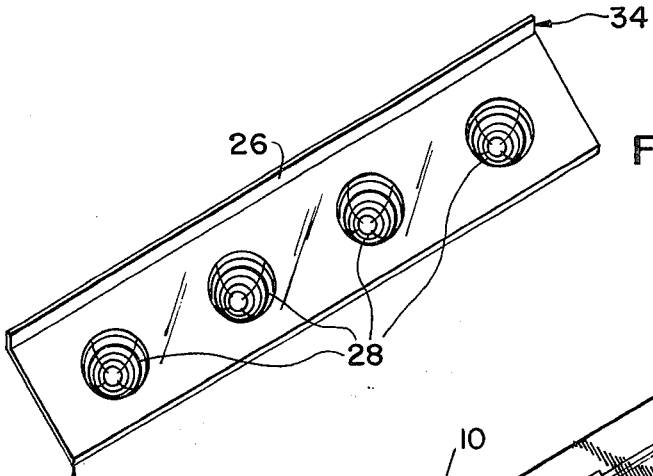
FIG. 4 is a perspective view of a liner element utilizable with the receptacle of FIG. 1.

Referring to the drawings, there is shown generally, as indicated by reference numeral 10, a receptacle for the storage of wads of used chewing gum. The receptacle includes a base member 12 which is elongated and may be substantially trapezoidal in cross-section. The base is formed with a plurality of longitudinally spaced recessed storage compartments 14. Desirably at least four of such compartments are formed in the base. Above each of such compartments there is desirably provided a frame member 16 having a transverse slot 18 therein. The slot is dimensioned so as to slidably receive a name plate identifying the adjacent compartment with a particular person.

A cover 20, preferably formed of a transparent synthetic plastics material, is provided to enclose all of the storage compartments. The cover is removably mounted on the base such as by forming raised portions 22 on the base member or, as depicted in FIG. 4, by providing liner 24, to be described, with a cover-retaining edge 26.

A liner 24 is provided for mounting on the base in overlying relation to compartments 14. The liner is elongated and is given a series of cup-like recessed areas 28 arranged in location and size so as to correspond with compartments 14 in the base. Thus, when the liner is juxtaposed over the top surface of the base the recessed areas of the liner nest within the corresponding compartments in the base and serve as the receiving surfaces for the wads of chewing gum 32 deposited therein. It will be understood that liner 24 is constructed of an inexpensive material to make feasible its disposed when the recessed areas 28 are filled with gum. The rear longitudinal edge 34 of the liner may be raised to present a cover-retaining edge 26.

Figure 1:
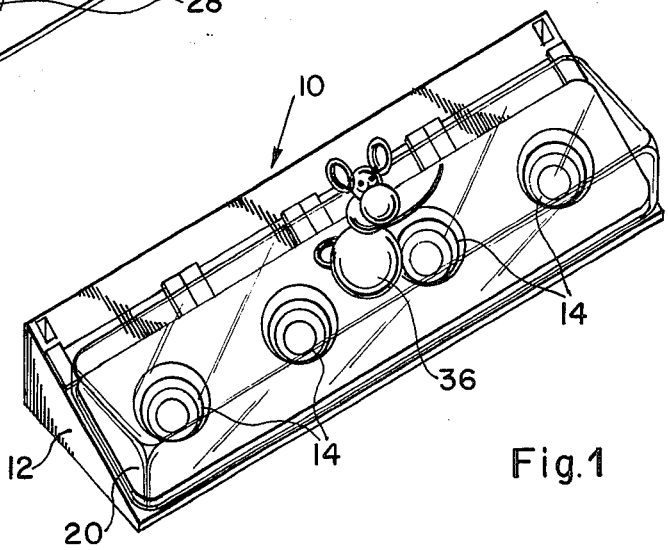
FIG. 1 is a perspective view of a used chewing gum receptacle embodying the features of the invention.
Figure 2:
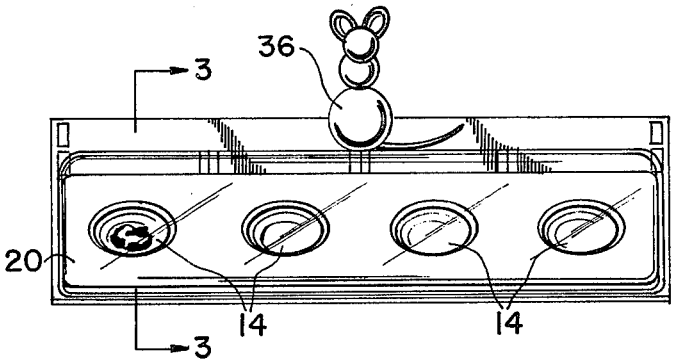
FIG. 2 is a front elevational view of the receptacle shown in FIG. 1.
Figure 3:
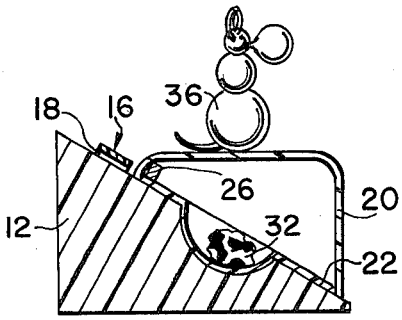
FIG. 3 is a cross-sectional view of the receptacle shown in FIG. 2 taken aong line 3—3 thereof.

The cover may be dome shaped as depicted in FIGS. 1 and 3 and an attractive ornament 36 may be provided for use as a handle.

From the foregoing it will be seen that a simply constructed gum receptacle has been provided which avoids the problem of gum removal discussed which characterized the prior art devices. The device of the invention, while of value as a novelty item, also serves a useful purpose and can be employed to eliminate the unsanitary condition frequently created heretofore by the littering of areas with used chewing gum.

I claim:

1. A storage receptacle for used chewing gum comprising in combination an elongated base member having an inclined upper wall, said base member being substantially trapezoidal in cross-section, a plurality of gum receiving storage cup-shaped compartments recessed into said inclined upper wall of said base member, a liner means for said cup-shaped compartments providing a surface for said gum deposited in said compartments, said liner means comprising a sheet juxtaposed over the top surface of said base member and having a series of cup-like recessed areas disposed in said cup-shaped compartments of said inclined upper wall of said base, an upwardly extending rear edge on said sheet, said sheet being removable and disposable, name means on said base member for holding name designations for said compartments, and a transparent cover mounted on said base member and having a rear edge resting on said inclined upper wall of said base member adjacent said upwardly extending rear edge of said sheet and co-operating with said rear edge to hold said cover in a position on said base member covering the compartments and movable to an open position permitting access to the compartments, said name means comprising a slotted frame member carried by said base member adjacent each of said storage compartments, each of said frame member being adapted to removably receive a name plate.

* * * * *